United States Patent [19]

Wood

[11] Patent Number: 4,475,272

[45] Date of Patent: Oct. 9, 1984

[54] SLIVER FORMING CONDENSER

[75] Inventor: Dennis E. Wood, Simpsonville, S.C.

[73] Assignee: Rando Machine Company, Macedon, N.Y.

[21] Appl. No.: 464,334

[22] Filed: Feb. 7, 1983

[51] Int. Cl.[3] ..... D01G 15/46

[52] U.S. Cl. ..... 19/106 R; 19/150; 19/151; 19/288

[58] Field of Search ..... 19/106 R, 150, 151, 19/288

[56] References Cited

U.S. PATENT DOCUMENTS

| | | | |
|---|---|---|---|
| 3,018,521 | 1/1962 | Harmon | 19/151 X |
| 3,135,023 | 6/1964 | Kalwaites | 19/151 X |
| 3,230,584 | 1/1966 | Kalwaites | 19/106 R |
| 3,256,569 | 6/1966 | Draving | 19/106 R |
| 3,787,930 | 1/1974 | Allen | 19/106 R |
| 4,274,178 | 6/1981 | Hotta | 19/106 R |

FOREIGN PATENT DOCUMENTS

| | | | |
|---|---|---|---|
| 1265013 | 3/1968 | Fed. Rep. of Germany | 19/150 |
| 1179532 | 5/1959 | France | 19/106 R |

*Primary Examiner*—Louis Rimrodt

*Attorney, Agent, or Firm*—Shlesinger, Fitzsimmons & Shlesinger

[57] ABSTRACT

A cylindrical condenser screen is mounted to rotate adjacent a fiber supply, and around a pair of vacuum plenums, one of which has a generally rectangularly shaped slot extending axially of the screen adjacent its inside surface. A low suction in said slot draws fibers from the supply and onto the screen in the form of a nonwoven web. A cover that overlies the screen and the low suction slot has thereon at least one tapered projection, which extends in the direction of the travel of the web and over at least one high suction slot formed in the other plenum. Atmospheric air, which is drawn into the high suction slot along the tapered side edges of the cover projection, causes the fibers in the web to be rolled or shifted inwardly beneath the projection, thereby to form the web into one or more slivers which are drawn from beneath the discharge end of the projection by conventional takeoff rolls. The screen can be mounted adjacent the lower end of a fiber feed chute or adjacent the takeoff roll of a carding machine.

13 Claims, 9 Drawing Figures

SLIVER FORMING CONDENSER

BACKGROUND OF THE INVENTION

This invention relates to sliver forming devices, and more particularly to a special type of pneumatic condenser which is mounted at the output of a carding machine or the like, and which utilizes air flow for separating a fiber web directly into a plurality of separate slivers or rovings.

In the production of yarns it is customary to separate a wound woven web, which is doffed from a carding machine or the like, into a plurality of separate, narrow ribbons or bands. These bands are then manipulated manually or by a number of mechanical devices to form a rope of material which is then passed into a trumpet and draft roller assembly to produce a product which is generally referred to as a sliver or roving.

Most forty inch wide carding machines used in the cotton industry produce a single sliver per machine. Although some can produce two slivers, it is very rare that more than two slivers are made from a single machine. In the woolen industry, however, where wider machines are employed, a number of ribbons or slivers are made by the use of a ribbon condenser which cuts the web structure (via small belts) into continuous ribbons, which are turned into woolen yarn, etc.

U.S. Pat. No. 3,018,521 discloses one type of strand forming apparatus heretofore employed for separating a fiber web into a plurality of spaced, parallel strands by conveying the web on a screen conveyor over a series of axially spaced rings, which rotate coaxially about a fluid dispensing plenum. Fluid under pressure is forced radially outwardly between the rings thereby separating the web into a plurality of spaced, parallel strands. The disadvantage of this apparatus is that it is designed to supplement the conventional web forming condenser and is not designed substantially simultaneously to form a web and in the same operation to roll its fibers into one or more slivers. Furthermore, as a practical matter, the apparatus disclosed by this patent requires that a liquid be dispensed from the plenum in order to retain the fibers in their strand or sliver forms.

Two other U.S. Pat. Nos. 3,135,023 and 3,230,584 disclose variations of the apparatus taught by the above-noted U.S. Pat. No. 3,018,521 . In certain of these embodiments the separating liquid is forced through a web that overlies, or is placed beneath, a plurality of parallel slots formed between spacer elements, which then cooperate with the dispensed fluid to separate the web into parallel strands. Certain of these embodiments also suggest passing the web over a slotted vacuum box so that the fluid (liquid) under pressure will pass through the web and into the vacuum box through its slots. However, neither of these latter two patents discloses apparatus which is designed to use two separate vacuum sources, one of relative low value for forming the web, and one of relatively high value for separating the web into one or more strands or slivers.

It is an object of this invention, therefore to construct improved sliver forming apparatus, which is capable of simultaneously forming carded fibers into a nonwoven web, and in the same operation forming the web into one or more slivers.

A further object of this invention is to provide a novel condenser construction which is adapted to be mounted at the output of a card successively to form carded fibers into a web, and then to divide the web into one or more slivers in substantially the same operation.

A more specific object of this invention is to provide a novel sliver forming apparatus including a condenser mechanism having both low and high vacuum sources used for successively forming carded fibers into an unwoven web, and then to form the web into one or more slivers.

Other objects will be apparent hereinafter from the specification and from the recital of the appended claims, particularly when read in conjunction with the accompanying drawings.

SUMMARY OF THE INVENTION

In one embodiment a cylindrical condenser screen is mounted to rotate about two vacuum manifolds, and beneath a generally Y-shaped cover which overlies a correspondingly shaped opening formed by the high vacuum manifold immediately beneath the condener screen. The low vacuum manifold opens beneath the condenser screen between a carding machine doffing roll and the legs of the high vacuum slot, and operates to form fibers into a nonwoven web extending transversely of the screen.

The rotating condenser screen advances the web beneath the two converging legs of the Y-shaped cover and over the correspondingly shaped high vacuum slot, so that the atmospheric air entering the high vacuum slot along the side edges of the Y-shaped cover causes the web to be separated into two strands which finally merge into a single strand at the juncture of the converging legs of the cover. The single strand is then drawn from beneath the terminal end of the common or base leg of the Y-shaped cover by a pair of take off rolls.

In other embodiments the novel condenser and associated cover are positioned at the lower end of a fiber supply chute so that fibers are drawn from the lower end of the chute and formed into a web by the lower vacuum plenum located within the condenser; and the web thus formed is immediately conveyed by the condenser screen over one or more slots in the low vacuum plenum, each of which has converging sidewalls located beneath a correspondingly shaped cover element, and each of which communicates, adjacent the point where its sidewalls merge, with the high vacuum manifold, whereby fibers in the web are caused by air flow to converge into one or more strands as they approach the point or points where the underlying sidewalls of the associated vacuum slot merge.

THE DRAWINGS

Figure 1:
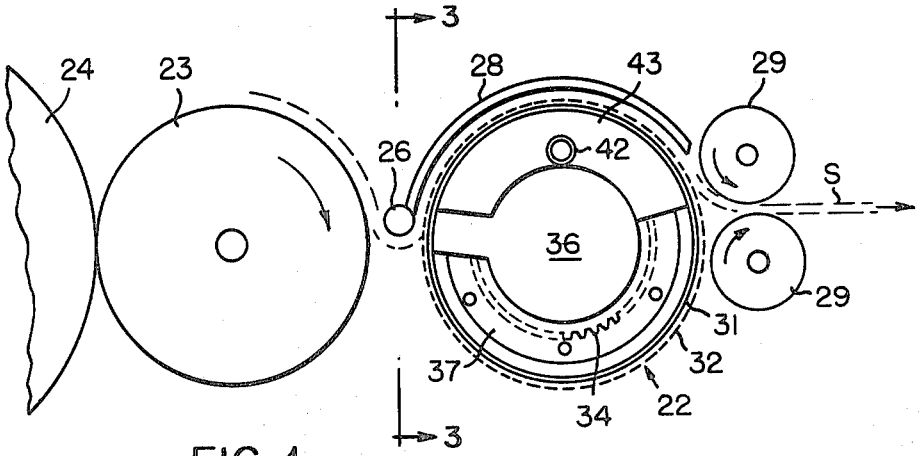
FIG. 1 is a fragmentary side elevational view of a sliver forming mechanism containing a novel sliver forming condenser and cover therefor made according to one embodiment of this invention, parts of the mechanism being illustrated diagramatically.
Figure 2:
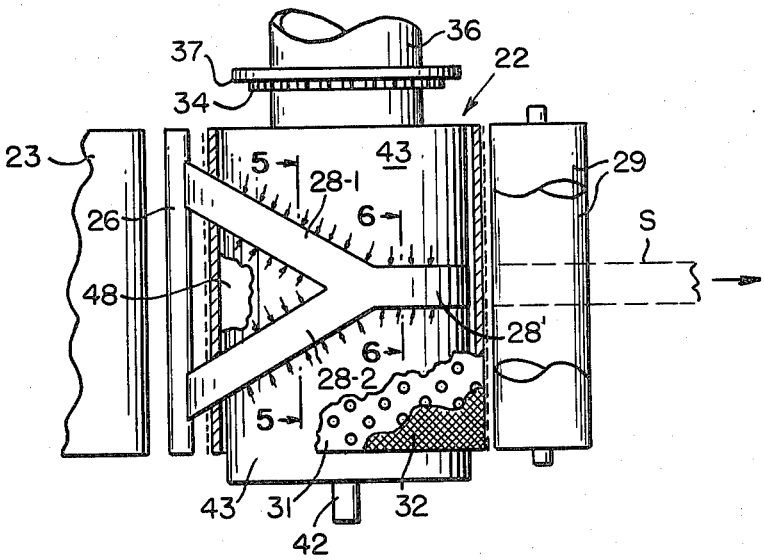
FIG. 2 is a fragmentary plan view of this mechanism, but with portions of the condenser being broken away and shown in section.
Figure 5:
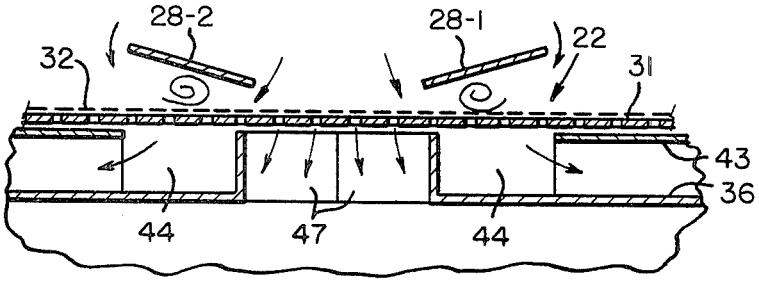
Figure 6:
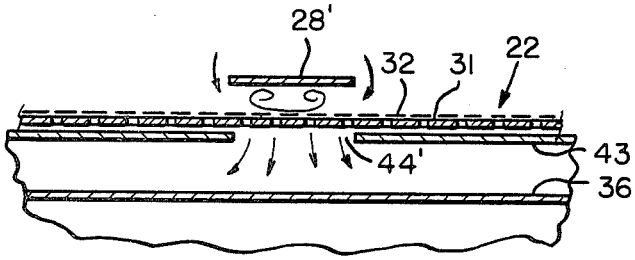
Figure 7:
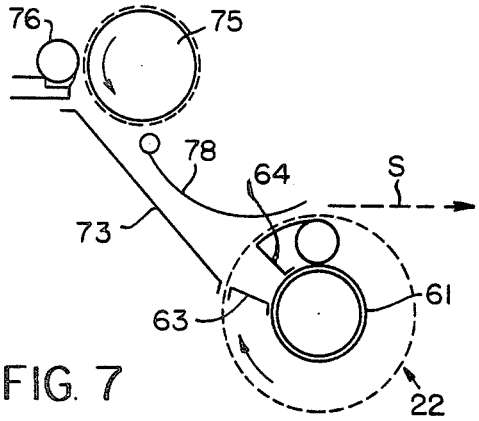
Figure 9:
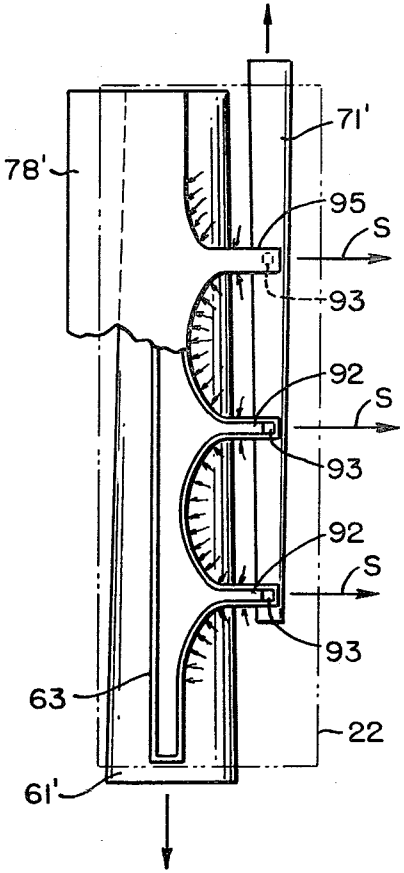
Figure 8:
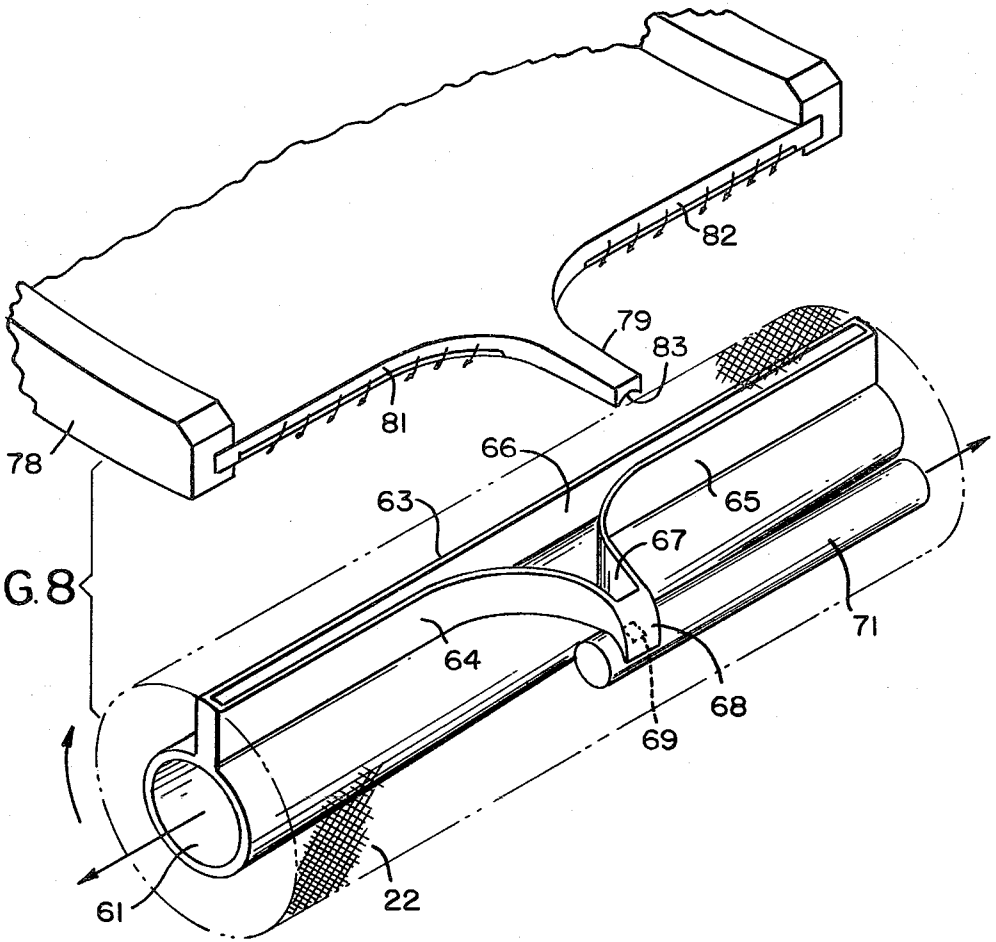

FIGS. 5 and 6 are enlarged sectional views taken along the lines 5—5 and 6—6, respectively, in FIG. 2, and illustrating typical configurations of the legs which form WpPart of the Y-shaped cover for this condenser;

FIG. 7 is a schematic side elevational view of a modified form of sliver forming condenser and cover therefor made according to a second embodiment of this invention;

FIG. 8 is an exploded perspective view of the sliver forming condenser and cover shown in FIG. 7, the cover portion being shown spaced from the condenser vacuum slot over which the fibers pass during sliver formation; and FIG. 9 is a fragmentary plan view of a modified form of the condenser and cover combination shown in FIGS. 7 and 8, the condenser screen in this third embodiment of the invention being shown in phantom by broken lines, and part of the condenser cover being broken away for purposes of illustration.

DETAILED DESCRIPTION OF THE PREFERRED EMBODIMENTS

Referring now to the drawings by numerals of reference, and first to FIGS. 1 to 3, 22 denotes generally a novel sliver forming condenser made according to one embodiment of this invention, and disposed to be mounted adjacent the doffer roll 23 for the main cylinder 24 of a carding machine, or the like. The fibers leaving the roll 23 pass beneath the rounded, forward edge 26 of a curved, stationary, specially-shaped cover 28, which overlies approximately the upper half of the condenser 22. As noted in greater detail hereinafter, the fibers which pass between the cover 28 and the cylinder 22 are formed into a sliver S, which is drawn from the condenser 22 beneath the forward end of cover 28 by a pair of take off rolls 29.

Figure 3:
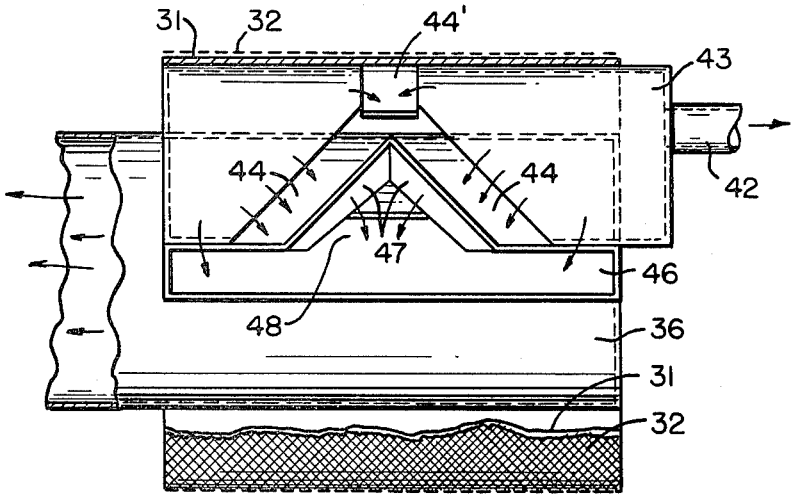
FIG. 3 is a fragmentary side elevational view of this sliver forming condenser as seen when viewed in the direction of the arrows denoted by line 3—3 in FIG. 1, but with the condenser cover removed, and with portions of the condenser being cut away and shown in section.

As shown more clearly in FIGS. 2 and 3, the condenser 22 comprises a perforated cylinder or drum 31, the outer surface of which is covered by a wire mesh or screen 32. Secured to or integral with one end of cylinder 31 (the upper end in FIG. 2) is a drive spocket or gear 34, which is disposed to rotate the cylinder 31 coaxially about a low vacuum drum or manifold 36. Secured to and surrounding the drum 36 adjacent the drive spocket 34 is a circumferential mounting plate 37 by means of which the drum 36 is adapted to be fixed to a stationary frame member (not illustrated) with one end thereof (the upper end in FIG. 2) connected to a low suction vacuum supply.

Secured to and surrounding part of the opposite, closed end of the drum 36 is a high suction or high vacuum manifold 43, which is adapted to be connected by a tubular section 42 thereof to a vacuum source (not illustrated) capable of creating a relatively high suction within the manifold 43 as noted hereinafter.

Figure 4:
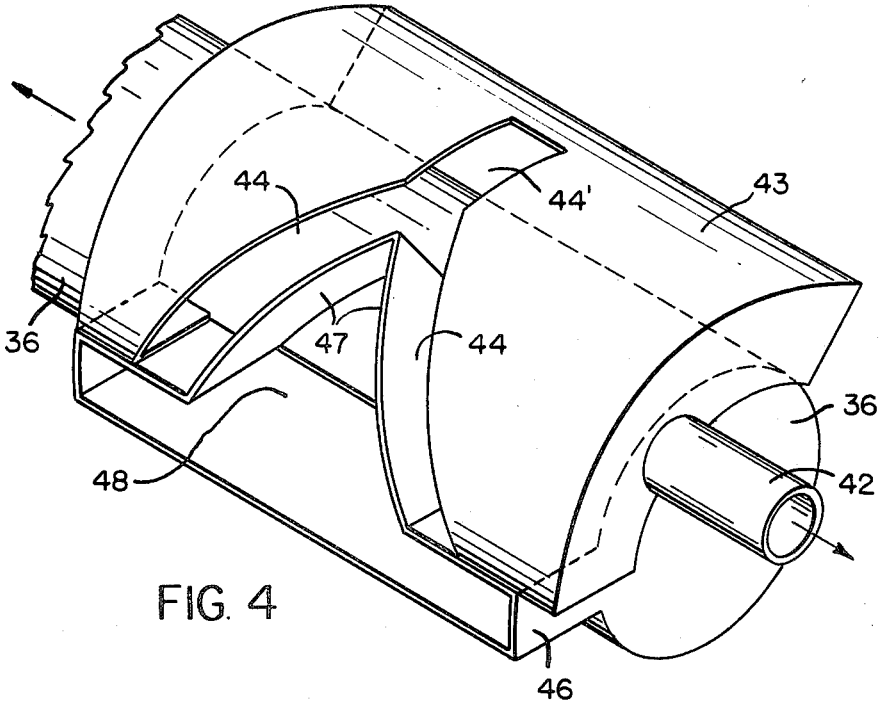
FIG. 4 is an enlarged perspective view of the cooperating low and high vacuum manifolds that form part of this novel condenser.

As shown more clearly in FIG. 4, the manifold 43 has an arcuate outer wall supported by the side walls of the manifold in radially spaced, coaxial relation to the outer peripheral surface of the drum 36. This outer wall of manifold 43 has formed therein a generally Y-shaped opening 44, which communicates with the interior of manifold 43, and thus through the duct 42 with the above-noted high vacuum supply, when the mechanism is in operabion. The sidewall 47 of the manifold 43, which is the wall that forms the inverted V-shaped point (FIGS. 3 and 4) where the legs of the Y-shaped slot 44 merge into its single leg or base section 44', forms one side of an otherwise generally rectangular duct 48, which communicates at its inner end with the interior of the low vacuum drum 36, and which opens at its outer end in closely spaced, confronting relation to the inner peripheral surface of drum 31.

Referring again to FIGS. 2 and 3, the generally Y-shaped slot 44 in the manifold 43 registers with the correspondingly shaped Y-shaped cover member 28, which as noted above is supported in a stationary position around the outside of the rotating condenser screen 32. In practice the condenser drum 31 and attached screen 32 rotate about plenums 36 and 43 in such manner that a slight space is left between the cover 28 and the screen 32. This, as shown for example in FIGS. 2 and 5, permits atmospheric air from outside of the unit to enter into the legs of the high vacuum slot 44 along the opposed, longitudinal side edges of each of the two leg sections 28-1 and 28-2 of the cover member 28. In the embodiment illustrated in FIG. 5 the respective legs 28-1 and 28-2 are shown to be inclined slightly relative to the plane of the rotating screen 32. It will be understood, however, that legs 28-1 and 28-2 could be arranged parallel to the outer surface of condenser 22, if desired, or could assume still different positions of inclination. Also, as shown in FIG. 6, the stem portion 28' of the cover 28 is disposed to overlie the corresponding stem portion 44' of the slot 44 in the high vacuum manifold, so that atmospheric pressure air is free to enter into the slot 44' along the opposed, longitudinal side edges of the stem portion 28' of the cover. In this figure the section 28' of the cover is shown to be parallel to the outer surface of the cylinder 22, but as noted above, this leg also could be inclined or as noted could even be of a different configuration.

In use, as fibers from roll 23 pass beneath the guide 26 they register first with the outer, open end of the duct 48, which therefore forms the fibers into a web which is caused to cling to the condenser screen 32 by virtue of the low vacuum suction then present in drum 36 and its formation duct 48. As the condenser screen 32 continues to rotate this web is conveyed beneath the cover 28 and over the converging legs of underlying Y-shaped slot 44, gradually approaching the apex or stem portion 28' of the cover. During this travel atmospheric air enters rapidly beneath the legs 28-1 and 28-2 of the cover as indicated by the arrows in FIGS. 2 and 5. The force of this air, and the rate at which it passes into slot 44 greatly exceeds the corresponding force and rate at which air passes through the fiber web and into the low vacuum opening 48. As a consequence, the fibers are caused to converge toward the two legs 28-1 and 28-2 as shown by the arrows in FIG. 5, thus separating the web into two, coiled strands, which are accumulated as shown by the coiled lines in FIG. 5 beneath the legs 28-1 and 28-2, respectively, of the cover member. As these two strands approach the throat of slot 44 the air flow also converges to a single path represented by the space beneath the cover leg 28' so that the two strands are thus combined into a single strand as the result of the atmospheric air which enters beneath the longitudinal side edges of the cover section 28'. The combined strands thus produce beneath the cover section 28' the silver S, which is then withdrawn from beneath the terminal end of section 28' by the takeoff rolls 29.

The advantage of this system is that the sliver S is continuously formed, as long as the fibers from the card are passed as a web beneath the Y-shaped cover 28. The air flow passing beneath the legs 28-1 and 28-2 of the cover cause the outermost fibers along the longitudinal side edges of the web to be drawn inwardly beneath the edges of the cover, while the fibers located toward the center of the web are separated and drawn outwardly beneath the inner or confronting edges of the cover legs 28-1 and 28-2. In addition to being rolled or coiled beneath the cover legs 28-1 and 28-2, the fibers are ultimately rolled into a single coil or sliver beneath the central or discharge leg 28' of the cover.

As will be apparent from reference to FIGS. 5 and 6, the particular manner in which the fibers are coiled beneath the respective legs 28-1 and 28-2 of the cover, as well as beneath its discharge leg 28', depends to a great deal upon the relative position of the cover with respect to the outer peripheral surface of the screen 32, and also on the cross sectional configuration of the cover legs. As shown in FIG. 5, if the two legs of the cover are inclined to the surface of the screen 32 it is possible to control the rate at which air flows beneath one side edge or the other of each leg, at least to the extent that a greater quantity of air will pass beneath the side of the leg which is spaced a further distance away from the screen 32. Generally this will cause the respective strands of fibers which accumulate beneath the legs to be coiled in the respective directions as illustrated by the coiled lines in FIG. 5. As shown in FIG. 6, when these two strands pass beneath the leg 28' of the cover, the two strands tend to roll or wrap spirally together into a single sliver.

Although not illustrated in the drawings, it will be apparent also, that instead of utilizing cover legs which have opposed, parallel surfaces, it would be possible to curve the legs intermediate their side edges so that each leg would form a concave surface facing in the direction of the condenser 22, thereby forming still another configuration in the strand which is formed beneath the respective leg.

FIGS. 7 to 9 illustrate still other ways of forming one or more slivers continuously from a web produced from fibers discharged from a fiber supply chute or the like.

In the embodiment shown in FIGS. 7 and 8 the condenser 22 includes a screen which rotates coaxially about an elongate, stationary, low vacuum drum 61 the outside diameter of which is substantially less than the inside diameter of the condenser screen. Drum 61 includes a radially projecting, axially extending duct 63 which for the most part is generally rectangular in configuration, as in the case of the duct 48 in the first embodiment. Duct 63 communicates at its inner end with the interior of the lower vacuum drum 61, and has its outer, open end disposed in closely spaced confronting relation to the inner surface of the rotating screen of condenser 22.

One side of the duct 63 is formed by two sidewall sections 64 and 65 which, adjacent the opposite ends, respectively, of the duct, extend parallel to the rear wall or side 66 of the duct. However, adjacent the middle of the duct the two sidewall sections 64 and 65 begin to curve away from the rear wall 66 and gradually toward each other until they reach a point where they are spaced from one another as at 67 a distance approximately equal to the desired width of the sliver which is to be formed by the mechanism. At their ends remote from the back wall 66 of the duct 63 the wall sections 64 and 65 are interconnected by a transverse end wall 68, which has in the bottom thereof a small opening 69 that communicates with the inner end of a high vacuum tube 71. Tube 71 extends at its opposite end parallel to the drum 61 beyond one end of the condenser 22, where it is adapted to be connected in a conventional manner to a vacuum system capable of applying through the opening 69 to the terminal end of the tapered duct slot 67 a very high suction pressure, at least as compared to that generated in the remainder of the duct 63 by virtue of the low suction or vacuum applied to the interior of drum 61.

In use the condenser 22 and associated drum 61 and tube 71 are adapted to be mounted adjacent the lower end of an inclined fiber formation chute 73 (FIG. 7), the upper end of which communicates with the discharge of a lickerin 75 that is mounted to rotate adjacent a fiber source 76 to draw fibers from the source 76 and to discharge them into the formation chamber 73.

One side of the chamber 73 (the upper side in FIG. 7) comprises a curved cover member 78, the lower end of which has formed thereon a narrow projection or extension 79, which is disposed to overlie the rotationg screen of condenser 22 in registry with the tapered opening or slot 67 formed in the upper end of the duct 63. As in the case of the sidewall sections 64 and 65 of the duct 63, the lower edge sections 81 and 82 (FIG. 8) of the cover member 78 curve outwardly and toward one another so as to register with the correspondingly curved, upper edges of the duct wall sections 64 and 65. Also as shown in FIG. 8, the underside of the cover projection 79 may be curved as at 83 to form a concave surface overlying the slot 67 in the vacuum duct 63.

In use, as the fibers accumulate in the lower end of chamber 73 the lower pressure vacuum created at the upper end of duct 63 causes the fibers to accumulate on the rotating screen of condenser 22 longitudinally thereof. As the condenser screen rotates the fibers thereon are gradually caused to be rolled or shifted axially inwardly of the condenser by virtue of the atmospheric air which passes beneath the lower edge of the cover 78 in the directions indicated by the arrows in FIG. 8. The rate at which the air passes beneath the edge of the cover 78 increases substantially toward the center of the condenser as defined by the space between the slot 67 and the overlying cover projection 79. In this particular area the vacuum is substantially higher by virtue of the communication of the high pressure or high vacuum tube 71 through the opening 69 with the outer end of slot 67. Because of this disposition of the air flow, the fibers on the screen of condenser 22 are caused to be bundled into a single sliver S (FIG. 7, which passes from beneath the outer, terminal end of the cover projection 79 to take up rolls or the like in a manner that will be apparent from the previously described embodiment.

In the embodiment shown in FIG. 9 the screen of condenser 22, which is shown in phantom by broken lines, is mounted to rotate about a modified low vacuum drum 61' and high vacuum tube 71', and beneath a modified cover member 78'. This embodiment is generally similar to that illustrated in FIGS. 7 and 8, except that instead of having a single converging slot 67 in its forward wall the duct 63' on the low vacuum drum 61' has formed in its forward wall three, sliver forming slots 92, which are connected at their lower ends to the high vacuum tube 71' by an opening or port 93. Also, the cover member 78 has formed thereon three equi-spaced projections 95 (one of which is shown in FIG. 9), which are positioned to overlie the slots 92 in the duct 63' in a manner similar to that in which the projection 79 overlies the slot 67 in the embodiment of FIGS. 7 and 8.

One distinguishing feature of this embodiment is that the cross sectional area of the drum 61 and the tube 71 decrease slightly as the distance away from the associated vacuum source increases. In other words, each tapers towards it closed end for the purpose of stablizing the degree of suction created at each of the slots 92 and openings 93, respectively.

As shown by the arrows in FIG. 9, when this embodiment is placed in use atmospheric air tends to pass beneath the cover member 79' in such manner as to divide the web into three separate strands or rovings, each of which is formed beneath one of the three cover projections 95, and which is discharged from the terminal end of the associated projection 95 in the form of a sliver S, which is then accumulated in a conventional manner.

From the foregoing it will be apparent that the present invention provides a relatively simple and inexpensive means for successively forming a web and then dividing it into one or more slivers in substantially the same operation. By using both low and high vacuum plenums in combination with carefully shaped vacuum slots and complimentary cover members, it is possible to utilize ambient, atmospheric air for pneumatically dividing a nonwoven fiber web into one or more slivers. Moreover, the novel sliver forming condensers disclosed herein are suitable for use at the output of a carding machine or a fiber formation chute, thus permitting the elimination of much of the apparatus heretofore employed separately to produce a nonwoven web on a condenser or the like, and thereafter using different apparatus for forming the web into a sliver.

Moreover, while the invention has been illustrated and described in detail in connection with only certain embodiments thereof, it is to be understood that it is capable of still further modification, and that this application is intended to cover any such modifications as may fall within the scope of one skilled in the art, or the appended claims.

Having thus described my invention, what I claim is:

1. Apparatus for forming and manipulating a fiber web into one or more slivers, comprising a perforated screen mounted to move in an endless path adjacent a fiber supply, a first plenum having therein an elongate, low suction slot extending transversely of said screen at the side thereof opposite said fiber supply, means for connecting said first plenum to a low vacuum source, whereby the suction created thereby in said low suction slot causes fibers from said source to be deposited on said screen in the form of a nonwoven web conveyed by said screen away from said source, a cover overlying said screen to register with said low suction slot, and having thereon at least one projection extending in the direction of movement of said screen, and gradually tapering to a width approximately equal to the desired width of a sliver, a second plenum having therein at least one high suction slot opening beneath said projection at the same side of said screen as said low suction slot, and means for connecting said second plenum to a high vacuum source, whereby as the web is advanced beneath said projection the air entering said high suction slot from beneath the tapering side edges of said cover projection causes the fibers of said web to be shifted inwardly toward each other to form a sliver beneath said projection.

2. Apparatus as defined in claim 1, wherein said low vacuum slot is generally rectangular in configuration, and said projection and said high vacuum slot therebeneath are generally Y-shaped in configuration and have their diverging leg portions facing in the direction of said low vacuum slot, whereby as the web advances beneath said projection it tends first to be formed into two slivers, which then merge into a single sliver beneath the terminal end portion of said projection.

3. Apparatus as defined in claim 2, wherein at least certain of the leg portions of said Y-shaped projections are disposed in planes inclined to the surface of said screen.

4. Apparatus as defined in claim 2, wherein said low suction slot is separated from said high suction slot by a common, generally V-shaped wall the apex of which extends between the diverging leg portions of the high suction slot.

5. Apparatus as defined in claim 1, wherein said cover has thereon a plurality of said projections spaced from each other in a direction laterally of said screen, and said second plenum has therein a plurality of said high suction slots positioned to register, respectively, with a different one of said projections, whereby said web is separated into a plurality of separate slivers as it advances beneath said projections.

6. Apparatus as defined in claim 5, including means connecting one side of said low suction slot at spaced points therealong to said high suction slots, whereby immediately following its formation said web begins to be divided into a plurality of slivers.

7. Apparatus as defined in claim 1, wherein said screen is in the form of a cylinder and said first and second plenums extend from opposite ends, respectively, of the cylindrical screen.

8. Apparatus as defined in claim 7, wherein said cover is curved coaxially of, and overlies at least a portion of, the outer peripheral surface of said screen.

9. A sliver forming condenser, comprising a cylindrical screen mounted to rotate adjacent a fiber supply, first vacuum means mounted in the bore of said screen to form adjacent its inside surface a low suction area extending axially of the screen, and operative to draw fibers from said supply to form them into a nonwoven web on said screen, a cover overlying said screen and said low suction area and having thereon at least one tapered projection extending in the direction in which said web is advanced by the rotating screen, and second vacuum means mounted in the bore of said screen to form adjacent its inside surface a high suction area which registers with and is similar in configuration to said projection, whereby air passing beneath the side edges of said tapered projection and into said high suction area causes the fibers in said web to be rolled progressively inwardly from opposite ends of the screen and beneath said projection, thereby to form the web into a sliver beneath said projection.

10. A sliver forming condenser as defined in claim 9, wherein said first vacuum means comprises a first plenum mounted in the bore of said screen and having therein an elongate, generally rectangularly shaped opening facing said screen to form said low suction area, said second vacuum means comprises a second plenum mounted in the bore of said screen and having therein a generally Y-shaped opening facing said screen to form said high suction area, and with the diverging legs of said Y-shaped opening facing in the direction of said low suction area, and said projection on said cover is generally Y-shaped and overlies the opening in said plenum.

11. A sliver forming condenser as defined in claim 10, wherein said first vacuum means comprises a generally rectangularly shaped duct opening adjacent said fiber supply, and with the side thereof closest to said supply extending parallel to the axis of said screen, and with the opposite side thereof having intermediate its ends at least one tapered recess extending in the direction of travel of the web, and beneath the projection on said cover.

12. A sliver forming condenser as defined in claim 11, wherein said opposite duct wall has a generally V-shaped portion defining said recess, and said second vacuum means forms a generally Y-shaped high suction area the divergent leg portions of which are separated by the apex of said V-shaped portion of the duct wall.

13. A sliver forming condenser as defined in claim 11, wherein said opposite duct wall has therein a plurality of said tapered recesses formed at spaced points therealong, said cover has a plurality of said projections formed thereon to overlie said tapered recesses, and said second vacuum means is connected to each of said tapered recesses adjacent its apex to create said high suction area therein.

* * * * *